US008181463B2

(12) United States Patent
Batscha et al.

(10) Patent No.: US 8,181,463 B2
(45) Date of Patent: May 22, 2012

(54) DIRECT HEATING ORGANIC RANKINE CYCLE

(75) Inventors: Dany Batscha, Kirat Ono (IL); Shlomi Argas, Yishayahu (IL); Avinoam Leshem, Raanana (IL)

(73) Assignee: ORMAT Technologies Inc., Reno, NV (US)

( * ) Notice: Subject to any disclaimer, the term of this patent is extended or adjusted under 35 U.S.C. 154(b) by 548 days.

(21) Appl. No.: 12/045,454

(22) Filed: Mar. 10, 2008

(65) Prior Publication Data

US 2008/0289313 A1 Nov. 27, 2008

Related U.S. Application Data

(63) Continuation-in-part of application No. 11/261,473, filed on Oct. 31, 2005, now Pat. No. 7,340,897.

(51) Int. Cl.
*F01K 7/34* (2006.01)
*F01K 25/08* (2006.01)
*F01K 25/00* (2006.01)

(52) U.S. Cl. ..... 60/653; 60/651; 60/671

(58) Field of Classification Search ..... 60/653, 60/651, 614–624, 671; 122/479.1, 479.2, 122/479.3

See application file for complete search history.

(56) References Cited

U.S. PATENT DOCUMENTS 2,548,508 A 4/1951 Wolfner
2,702,531 A * 2/1955 Epley ..... 122/479.1
3,040,528 A * 6/1962 Tabor et al. ..... 60/653
3,292,366 A * 12/1966 Rice et al. ..... 60/651
3,436,912 A 4/1969 Squires
3,478,726 A * 11/1969 Kikinis ..... 122/406.1
3,789,804 A * 2/1974 Aguet ..... 122/1 R
3,969,891 A * 7/1976 Aguet ..... 60/39.182
3,974,642 A 8/1976 Pacault
4,184,325 A 1/1980 Mandrin
4,232,522 A * 11/1980 Steiger ..... 60/618
4,235,077 A * 11/1980 Bryant ..... 60/618
4,272,953 A 6/1981 Rice (Continued)

FOREIGN PATENT DOCUMENTS

JP 58-171492 10/1983
JP 58-171495 10/1983

OTHER PUBLICATIONS

"600 kW Organic Rankine Cycle Waste Heat Recovery Power Conversion System", Cheek, R. M.; Lacey, P.D., was published in the Proceedings of the International Energy Conversion Engineering Conference, 12th, Washington, D.C., Aug. 28-Sep. 2, 1977, vol. 2 (A77-48701 23-44) La Grange Park, Ill., American Nuclear Society, Inc., 1977, p. 1095-1099.

(Continued)

*Primary Examiner* — Thomas Denion
*Assistant Examiner* — Christopher Jetton
(74) *Attorney, Agent, or Firm* — Oblon, Spivak, McClelland, Maier & Neustadt, L.L.P.

(57) ABSTRACT

The present invention provides an organic Rankine cycle power system, which comprises means for superheating vaporized organic motive fluid, an organic turbine module coupled to a generator, and a first pipe through which superheated organic motive fluid is supplied to the turbine, wherein the superheating means is a set of coils through which the vaporized organic motive fluid flows and which is in direct heat exchanger relation with waste heat gases.

16 Claims, 3 Drawing Sheets

U.S. PATENT DOCUMENTS

| | | | | |
|---|---|---|---|---|
| 4,290,390 | A * | 9/1981 | Juzi | 122/406.4 |
| 4,353,204 | A | 10/1982 | Arakawa | |
| 4,562,995 | A * | 1/1986 | Enjo et al. | 252/67 |
| 4,901,531 | A * | 2/1990 | Kubo et al. | 60/618 |
| 5,632,143 | A | 5/1997 | Fisher et al. | |
| 5,640,842 | A | 6/1997 | Bronicki | |
| 5,687,570 | A | 11/1997 | Bronicki et al. | |
| 5,713,195 | A | 2/1998 | Bronicki et al. | |
| 5,799,490 | A | 9/1998 | Bronicki et al. | |
| 6,158,221 | A * | 12/2000 | Fancher et al. | 60/649 |
| 6,167,706 | B1 * | 1/2001 | Bronicki et al. | 60/651 |
| 6,571,548 | B1 | 6/2003 | Bronicki et al. | |
| 6,960,839 | B2 * | 11/2005 | Zimron et al. | 290/2 |
| 2005/0103016 | A1 * | 5/2005 | Radcliff et al. | 60/670 |
| 2008/0060357 | A1 | 3/2008 | Zimron et al. | |

OTHER PUBLICATIONS

"Power Generation Throuch Waste Heat Recovery" of the Sundstrand Energy Systems company, a unit of Sundstrand Corporation, Jun. 1981.

"Power Generation From Waste Heat Using Organic Rankine Cycle Systems", Prasad, Anil, was published and presented at the Industrial Energy Technology Conference (IETC), Houston, Texas, Apr. 13-16, 1980, ESL-80/04-116.

Rapid Screening of Fluids for Chemical Stability in Organic Rankine Cycle Applications, Wendy C. Andersen and Thomas J. Bruno, Physical and Chemical Properties Division, National Institute of Standards and Technology, 325 Broadway, Boulder, Colorado 80305-3328. Ind. Eng. Chem. Res., 2005, 44 (15), pp. 5560-5566.

* cited by examiner

DIRECT HEATING ORGANIC RANKINE CYCLE

FIELD OF THE INVENTION

The present invention relates to the field of waste heat recovery systems. More particularly, the invention relates to a direct heating organic Rankine cycle.

BACKGROUND OF THE INVENTION

Many waste heat recovery systems employ an intermediate heat transfer fluid to transfer heat from waste heat gases, such as the exhaust gases of a gas turbine, or waste heat gases from industrial processes in stacks to a power producing organic Rankine cycle (ORC) system. One of these waste heat recovery systems is disclosed in U.S. Pat. No. 6,571,548, for which the intermediate heat transfer fluid is pressurized water. Further waste heat recovery systems are disclosed in U.S. patent application Ser. No. 11/261,473 and U.S. patent application Ser. No. 11/754,628, the disclosures of which are hereby incorporated by reference, in which intermediate heat transfer fluids are used from which power can also be produced.

The thermal efficiency of such a prior art waste heat recovery system is reduced due to the presence of the intermediate heat transfer fluid. Furthermore, the capital and operating costs associated with the intermediate fluid system are relatively high.

It would therefore be desirable to obviate the need of an intermediate fluid system by providing a direct heating organic Rankine cycle, i.e. one in which heat is transferred from waste heat gases to the motive fluid without any intermediate fluid circuit. However, a directly heated organic motive fluid achieves higher temperatures than one in heat exchanger relation with an intermediate fluid, and therefore suffers a risk of degradation when brought to heat exchanger relation with waste heat gases and heated thereby as well as a risk of ignition if the organic motive fluid leaks out of e.g. a heat exchanger.

It is an object of the present invention to provide a waste heat recovery system based on a direct heating organic Rankine cycle.

It is an additional object of the present invention to provide a direct heating organic Rankine cycle which safely, reliably and efficiently extracts the heat content of waste heat gases to produce power.

Other objects and advantages of the invention will become apparent as the description proceeds.

SUMMARY OF THE INVENTION

The present invention provides an organic Rankine cycle power system, which comprises means for superheating vaporized organic motive fluid, an organic turbine module coupled to a generator, and a first pipe through which superheated organic motive fluid is supplied to said turbine, wherein said superheating means is a set of coils through which the vaporized organic motive fluid flows and which is in direct heat exchanger relation with waste heat gases.

The present invention provides a waste heat vapor generator for supplying vapor to a turbogenerator, comprising an inlet through waste heat gases are introduced, an outlet from which heat depleted waste heat gases are discharged, a chamber interposed between said inlet and said outlet through which said waste heat gases flow, and preheater or preheater coil, boiler or boiler coil, and superheater or superheater coil through which organic motive fluid flows, the preheater or preheater coil, boiler or boiler coil, and superheater or superheater coil being housed in the chamber and in heat exchanger relation with the waste heat gases, wherein the boiler or boiler coil are positioned upstream to the superheater or superheater coil, and the superheater or superheater coil are positioned upstream to the preheater or preheater coil.

Alternatively, the present invention provides a waste heat vapor generator for supplying vapor to a turbogenerator, comprising an inlet through waste heat gases are introduced, an outlet from which heat depleted waste heat gases are discharged, a chamber interposed between said inlet and said outlet through which said waste heat gases flow, and preheater or preheater coil, a boiler, and superheater or superheater coil through which organic motive fluid flows, the preheater or preheater coil, boiler, and superheater or superheater coil being housed in the chamber and in heat exchanger relation with the waste heat gases, wherein the boiler is positioned upstream to the superheater or superheater coil, and the superheater or superheater coil are positioned upstream to the preheater or preheater coil.

The present invention is also directed to an organic Rankine cycle power system, comprising means for superheating vaporized organic motive fluid, preferably a single organic turbine coupled to a generator, and a first pipe through which superheated organic motive fluid is supplied to the turbine.

In one embodiment, the superheating means comprises a waste heat vapor generator having an inlet through waste heat gases are introduced, an outlet from which heat depleted waste heat gases are discharged, a chamber interposed between the inlet and the outlet through which the waste heat gases flow, and preheater coils, boiler coils, and superheater coils to which the second pipe extends, the preheater coils, boiler coils, and superheater coils being housed in the chamber and in heat exchanger relation with the waste heat gases, wherein the boiler coils are positioned upstream to the superheater coils, and the superheater coils are positioned upstream to the preheater coils. The motive fluid discharged from the preheater coils is preferably delivered to the boiler coils.

In a further embodiment, the superheating means comprises a waste heat vapor generator having an inlet through waste heat gases are introduced, an outlet from which heat depleted waste heat gases are discharged, a chamber interposed between the inlet and the outlet through which the waste heat gases flow, and preheater coils, a boiler, and superheater coils to which the second pipe extends, the preheater coils, boiler, and superheater coils being housed in the chamber and in heat exchanger relation with the waste heat gases, wherein the boiler is positioned upstream to the superheater coils, and the superheater coils are positioned upstream to the preheater coils. The motive fluid discharged from the preheater coils is preferably delivered to the boiler.

The power system preferably comprises means for limiting a temperature increase of the superheated organic motive fluid.

In one embodiment, the means for limiting a temperature increase of the superheated organic motive fluid comprises a desuperheating valve through which liquid organic motive fluid is delivered to a second pipe extending to the superheating means through which the vaporized motive fluid flows. The desuperheating valve is operable to regulate the flow of motive fluid through a third pipe which extends to the second pipe in response to the temperature of the superheated motive fluid flowing through the first pipe.

In a further embodiment, the means for limiting a temperature increase of the superheated organic motive fluid comprises a bypass valve through which a portion of the waste heat gases flow when the temperature of the waste heat gases exiting the waste heat vapor generator is greater than a predetermined value.

In an alternative, the system preferably comprises a separator for receiving two-phase motive fluid from the boiler coils and for separating the two-phase fluid into a vapor phase fluid and a liquid phase fluid, wherein the vapor phase fluid is delivered to the superheater coils via the second pipe.

A pump delivers the liquid phase fluid to a boiler supply control valve at a predetermined mass flow rate and to the desuperheating valve.

The present invention is also directed to a desuperheating method, comprising the steps of vaporizing an organic motive fluid, superheating the vaporized fluid, delivering the superheated fluid to a turbogenerator to generate electricity, and mixing liquid phase motive fluid with the vaporized fluid in response to a temperature of the superheated fluid which is above a predetermined level.

BRIEF DESCRIPTION OF THE DRAWING

Embodiments are described, by way of example, with relation to the accompanying drawings wherein.

DETAILED DESCRIPTION OF PREFERRED EMBODIMENTS

Figure 1:
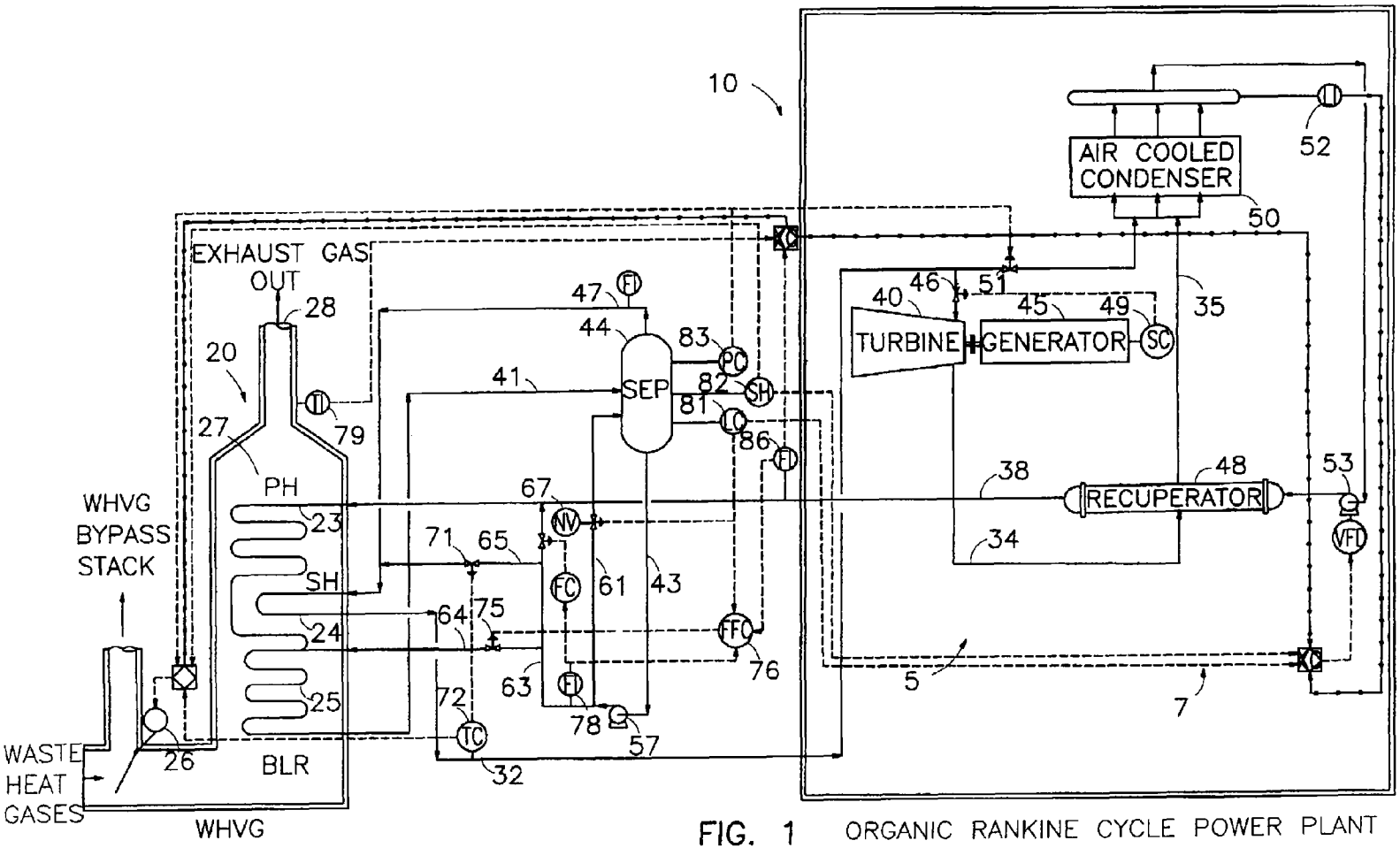
FIG. 1 is a schematic process diagram of a directly heated organic Rankine cycle power system, according to one embodiment of the invention.

FIG. 1 illustrates an embodiment of a closed, directly heated organic Rankine cycle (ORC) power system, which is designated by numeral 10. The solid lines represent the piping system 5 through which the motive fluid flows and the dashed lines represent the electrical connection of various components of the control system 7.

The motive fluid of the Rankine cycle, which may be an organic fluid e.g. n-pentane, isopentane, hexane or isododecane, or mixtures thereof and preferably isopentane is brought into heat exchange relation with waste heat gases, such as the exhaust gases of a gas turbine or a furnace or waste heat gases from industrial processes in stacks, by means of a waste heat vapor generator (WHVG) 20, which is a multi-component heat exchanger unit, as will be described hereinafter. Isopentane is the preferred motive fluid due to its relatively high auto-ignition temperature. As the waste heat gases are introduced to inlet 21 of WHVG 20 and discharged as heat depleted waste heat gases from outlet 28, the motive fluid flows across heating coils positioned within chamber 27 interposed between inlet 21 and outlet 28 of WHVG 20 and is heated by the waste heat gases, which flow across the heating coils. WHVG 20 generates superheated motive fluid, which is supplied via pipe 32 to an organic turbine module 40, which may comprise one or several turbines but, preferably and advantageously a single turbine providing a cost effective power unit. A single turbine may comprise several pressure stages e.g. three pressure stages, and may be provided with a substantially large shaft and correspondingly substantially large bearings on which the shaft is rotatably mounted to ensure reliable and continuous operation of the turbine unit. Turbine module 40 is coupled to generator 45, for producing electricity, e.g. of the order of up to approximately 10 MW. By employing a cost effective single turbine 40 of relatively large dimensions, the rotational speed of the turbine will be lowered. Thus, the rotational speed of the turbine can be synchronized with that of generator 45, without the use of a gear, to a relatively low speed of e.g. 1500-1800 rpm, thereby enabling the use of a relatively inexpensive generator.

Control valve 46 is provided to provide rotational speed control of turbine module 40 by use in conjunction with speed control sensor 49. Additionally, turbine bypass valve 51 is provided to supply motive fluid to condenser 50 when necessary.

The expanded motive fluid vapor, after work has been performed by turbine module 40, flows via pipe 34 to recuperator 48. The motive fluid exits recuperator 48 and is supplied via pipe 35 to condenser 50, which may be air-cooled as shown, if preferred or water cooled. Cycle pump 53 supplies condensate, produced in condenser 50, to recuperator 48, where the condensate is heated with heat present in expanded motive fluid, and thereafter to preheater (PH) coils 23 of WHVG 20 via pipe 38. The preheated motive fluid flows to boiler (BLR) coils 25 of WHVG 20 where organic motive fluid vapor is produced. Two-phase motive fluid, i.e. liquid and vapor present in the boiler coils, is supplied from boiler coils 25 to separator 44 via pipe 41, and separated thereby into a vapor phase fluid which flows out of the separator through pipe 47 and into a liquid phase fluid which flows out of separator 44 through pipe 43 to pump 57. The discharge of pump 57 branches, flowing through pipe 61 which extends back to separator 44 and through pipe 63, which combines with pipe 38 and provides a desired mass flow rate of liquid motive fluid to preheater 23. The vapor phase fluid discharged from separator 44 is delivered via pipe 47 to superheater (SH) coils 24 of WHVG 20. Pipe 63 through which the separated liquid phase fluid flows branches into pipe 64 extending to BLR coils 25 and into pipe 65, which combines with pipe 47 leading to SH 24. As described above, the discharge from superheater 24 is delivered to turbine module 40.

Figure 2:
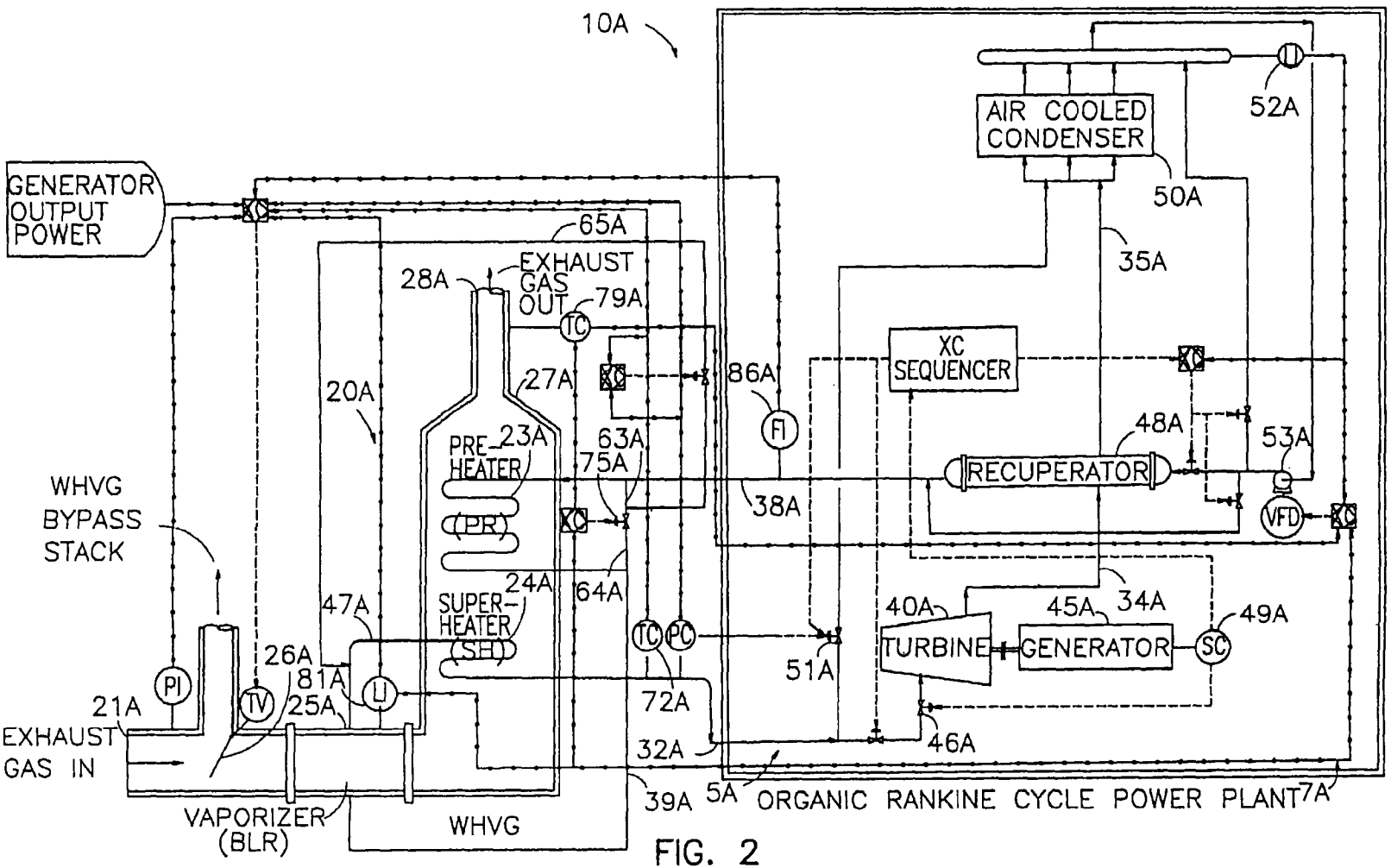
FIG. 2 is a schematic process diagram of a directly heated organic Rankine cycle power system, according to another embodiment of the invention.

Turning to FIG. 2, a further embodiment of a closed, directly heated organic Rankine cycle (ORC) power system is illustrated, which is designated by numeral 10A. The solid lines represent the piping system 5A through which the motive fluid flows and the dashed lines represent the electrical connection of various components of the control system 7A.

The motive fluid of the Rankine cycle, which may be an organic fluid e.g. n-pentane, isopentane, hexane or isododecane, or mixtures thereof and preferably isopentane is brought into heat exchange relation with waste heat gases, such as the exhaust gases of a gas turbine or a furnace or waste heat gases from industrial processes in stacks, by means of a waste heat vapor generator (WHVG) 20A, which is a multi-component heat exchanger unit, as will be described hereinafter. Isopentane is the preferred motive fluid due to its relatively high auto-ignition temperature. As the waste heat gases are introduced to inlet 21A of WHVG 20A and discharged as heat depleted waste heat gases from outlet 28A, the motive fluid flows across heat exchangers associated with chamber 27A interposed between inlet 21A and outlet 28A of WHVG 20A and is heated by the waste heat gases, which flow across the heat exchangers. WHVG 20A generates superheated motive fluid, which is supplied via pipe 32A to an organic turbine module 40A, which may comprise one or several turbines but, preferably and advantageously a single turbine providing a cost effective power unit. A single turbine may comprise several pressure stages e.g. three pressure stages, and may be provided with a substantially large shaft and correspondingly substantially large bearings on which the shaft is rotatably mounted to ensure reliable and continuous operation of the turbine unit. Turbine module 40A is coupled to generator 45A, for producing electricity, e.g. of the order of up to approximately 10 MW. By employing a cost effective single turbine 40A of relatively large dimensions, the rotational speed of the turbine will be lowered. Thus, the rotational speed of the turbine can be synchronized with that of generator 45A, without the use of a gear, to a relatively low speed of e.g. 1500-1800 rpm, thereby enabling the use of a relatively inexpensive generator.

Control valve 46A is provided to provide rotational speed control of turbine module 40A by use in conjunction with speed control sensor 49A. Additionally, turbine bypass valve 51A is provided to supply motive fluid to condenser 50A when necessary.

The expanded motive fluid vapor, after work has been performed by turbine module 40A, flows via pipe 34A to recuperator 48A. The motive fluid exits recuperator 48A and is supplied via pipe 35A to condenser 50A, which may be air-cooled as shown, if preferred or water cooled. Cycle pump 53A supplies condensate, produced in condenser 50A, to recuperator 48A, where the condensate is heated with heat present in expanded motive fluid, and thereafter to preheater (PH) coils 23A of WHVG 20A via pipe 38A. The preheated motive fluid flows to boiler (BLR) or vaporizer 25A of WHVG 20A, preferably a shell and tube boiler, having the motive fluid on the shell side and the hot waste gases o the tube side, via pipe 39A where organic motive fluid vapor is produced by pool boiling in BLR or vaporizer 25A. If the temperature of the waste heat exhaust gases is low, then control valve 75A is operated to permit portion or even all, if preferred, of the motive fluid to by-pass preheater 23A and to be supplied to boiler or vaporizer 25A via pipe 63A. The organic motive fluid vapor discharged from boiler (BLR) or vaporizer 25A is delivered via pipe 47A to superheater (SH) coils 24A of WHVG 20A. Pipe 65A which branches from pipe 63A supplies the liquid motive fluid to SH 24A if the pressure and temperature of the superheated vapors in pipe 32A too high. As described above, the discharge from superheater 24A is delivered to turbine module 40A.

Figure 3:
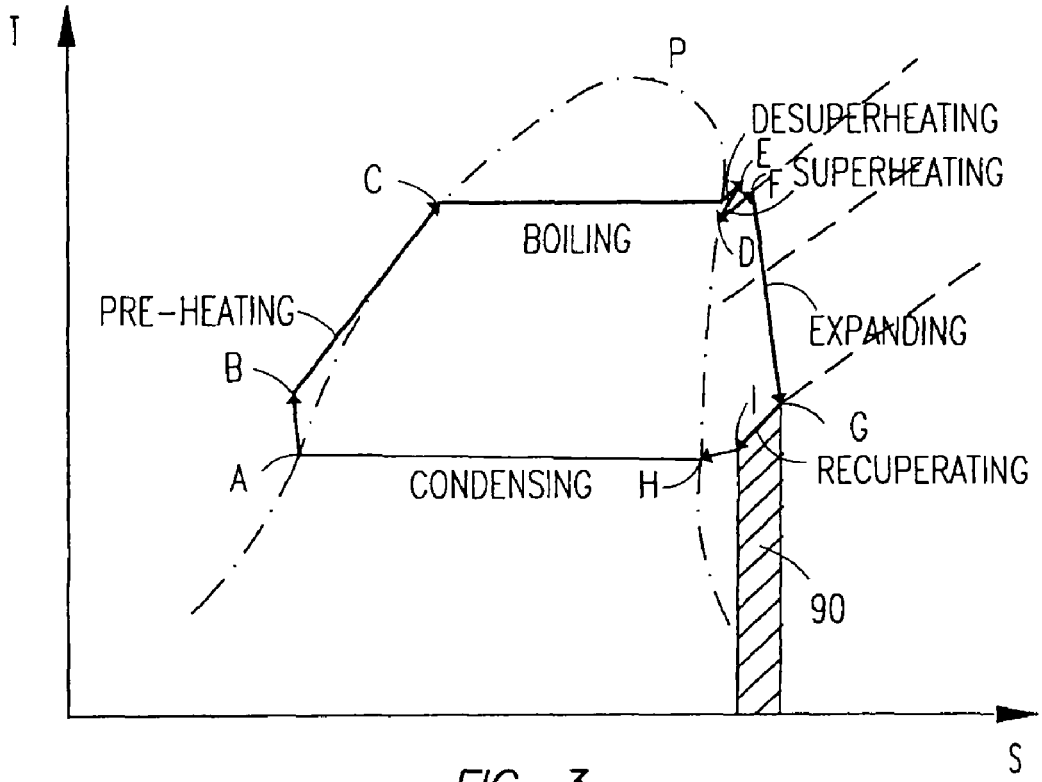
FIG. 3 is a temperature-entropy graph of a motive fluid by which power is produced with the power system of FIG. 1 or FIG. 2.

The operation/utility of the present invention may be appreciated by referring to FIG. 3, which illustrates a temperature-entropy graph of an organic motive fluid such as isopentane when operating in accordance with the thermodynamic cycle of the present invention. The shape of the temperature-entropy graph of other organic motive fluids is similar.

The level of power production of the ORC power system of the present invention is increased relative to prior art ORC systems by superheating the organic motive fluid. It is well known to superheat steam in order to increase its quality before introduction to a turbine, to prevent corrosion of the turbine blades which would normally result when the moisture content of vaporized steam increases upon expansion within the turbine. In contrast to the temperature-entropy graph of steam, which is bell-shaped and expansion of the saturated steam increases its moisture content, the temperature-entropy diagram of the organic motive fluid shown in FIG. 3 is skewed. That is, critical point P delimiting the interface between saturated and superheated regions is to the right of the centerline of the isothermal boiling step from state c to state e (in boiler coils 25 or boiler 25A, see FIGS. 1 and 2 respectively), at which the motive fluid is generally saturated vapor but may be superheated as illustrated, and of the centerline of the isothermal condensing step from state h to state a (in condenser 50 or condenser 50A, see FIGS. 1 and 2 respectively). Accordingly, expansion of non-superheated saturated vapor at state d within the turbine would cause the organic motive fluid to become superheated. Thus, there has not been any motivation heretofore, when utilizing waste heat, to superheat the organic motive fluid before being introduced to the turbine since the expanded motive fluid will be, in any case, in the superheated region, and therefore there is no risk that the turbine blades will become corroded.

During the superheating step from state e to state f (in superheater coils 24 or 24A, see FIGS. 1 and 2 respectively), the temperature and pressure of the organic motive fluid increase after being boiled. The temperature and pressure of the organic motive fluid decreases as it is expanded at close to substantially constant entropy to state g (in turbine 40 or 40A, see FIG. 1 or 2 respectively) across the turbine blades, and its temperature further decreases from state g to state h during the recuperating stage (in recuperator 48 or 48A, see FIGS. 1 and 2 respectively). Shaded region 90 represents the heat extracted during the recuperating stage so that the use of recuperators 48 or 48A advantageously permit a substantial amount of superheat to be recovered and input into the motive fluid. The superheated and expanded motive fluid at state i is supplied to condenser 50 or 50A in order to return the motive fluid to state a. The change from state a to state b, shown in FIG. 3, represents the heating of the motive fluid condensate, supplied from condenser 50 or 50A, in recuperator 48 or 48A, while the preheating of the motive fluid liquid in preheater 23 or 23A respectively is shown in FIG. 3 by change from state b to state c such that the cycle repeats.

While the thermal efficiency and power output of the directly heated ORC power system of the present invention is increased relative to a prior art ORC employing an intermediate fluid to transfer heat from waste heat gases, due to the increased heat influx to the motive fluid, the motive fluid circulating through a directly heated ORC power system risks decomposition and ignition. An isopentane motive fluid, for example, is superheated at approximately a temperature of 250° C., depending on its pressure, and its auto-ignition point is 420° C. at atmospheric pressure. Due to the relatively small difference between a superheating temperature and an auto-ignition temperature, an important aspect of the present invention is the limiting of the temperature increase of the superheated motive fluid and consequently ensuring the stability of the organic motive fluid.

Referring back to FIGS. 1 and 2, the configuration of WHVG 20 or 20A is one way of limiting the temperature increase of the superheated motive fluid. As described hereinabove, WHVG 20 comprises the three sets of coils PH coils 23, SH coils 24, and BLR coils 25 while WHVG 20A comprises three heat exchangers, PH coils 23A, SH coils 24A and boiler 25A. BLR coils 25 or BLR 25A are positioned at the upstream side of WHVG 20 or WHVG 20A, and are exposed to the highest temperature of the waste heat gases, which are introduced to WHVG 20 or 20A at inlet 21 or inlet 21A and provide the latent heat of vaporization for the motive fluid. SH coils 24 or 24A are positioned immediately downstream to BLR coils 25 or BLR 25A. As the temperature of the waste heat gases decreases after transferring heat in BLR coils 25 or BLR 25A, the heat transfer rate to SH coils 24 or 24A is decreased and therefore the temperature increase of the superheated motive fluid is advantageously limited. Even though the temperature increase of the superheated motive fluid is limited, the heat transfer rate to SH coils 24 or 24A is sufficiently high to superheat the motive fluid. The heat transfer rate to SH coils 24 or 24A may be supplemented by increasing the mass flow rate of the motive fluid through SH coils 24 or 24A or by increasing the surface area of SH coils 24 or 24A which is exposed to the waste heat gases. PH coils 23 or 23A are positioned on the downstream side of WHVG 20 or 20A, and are exposed to the relatively low temperature of the waste heat gases after having flown across SH coils 24 or 24A. The heat depleted waste heat gases exit WHVG at outlet 28 or 28A. While this order of heat exchangers described above is preferred, according to the present invention, i.e. BLR coils 25 or BLR 25A upstream in WHVG 20 or 20A, SH coils 24 or 24A positioned immediately downstream to BLR coils 25 or BLR 25A and PH coils 23 or 23A downstream to SH coils 24 or 24A on the downstream side of WHVG 20 or 20A, other configurations or orders of heat exchangers can be used in accordance with the present invention. The preferred order permits the motive fluid to have a known temperature at the inlet or upstream side of WHVG 20 or 20A and also permits relatively high efficiency levels to be achieved in the power cycle. In addition, by using, according to the preferred order of heat exchangers, PH coils 23 or 23A at the downstream side of WHVG 20 or 20A where relatively low temperatures of the waste heat gases exist, effective heat source to motive fluid heat transfer is achieved.

An additional way presented by the present invention to limit the temperature increase of the superheated motive fluid is by de-superheating the motive fluid. In the embodiment described with reference to FIG. 1, the de-superheating method is carried out by mixing the liquid separated from the two-phase boiled motive fluid and supplied by pump 57 via pipe 65 with the separated vapor flowing through pipe 47, in order to lower or control the motive fluid temperature prior to the superheating step. In the embodiment described with reference to FIG. 2, the de-superheating method is carried out by mixing the liquid supplied by pipe 63A and subsequently via pipe 65A with the vapor flowing through pipe 47A, in order to lower or control the motive fluid temperature prior to the superheating step. Thus, with reference to FIG. 3, the desuperheating step causes the state of the motive fluid to change from state e to state d, which may correspond to a state of saturated vapor as shown. During the subsequent superheating step from state d to state f, the temperature of the motive fluid increases to a level which is greater than that of the motive fluid at state e at the end of the boiling step. De-superheating control valve 71 or 71A (see FIG. 2) regulates the flow of liquid motive fluid through pipe 65 or 65A respectively in response to the temperature of the superheated motive fluid flowing through pipe 32 or 32A, as detected by temperature sensor 72 or 72A in fluid communication with the latter. De-superheating control valve 71 or 71A in electric communication with sensor 72 or 72A is incrementally opened when the temperature of the motive fluid flowing through pipe 32 or 32A is higher than a certain set point, and is incrementally closed when the temperature of the motive fluid flowing through pipe 32 or 32A is lower than a certain other set point.

A further way of limiting the temperature increase of the superheated motive fluid is by diverting waste heat gases from WHVG inlet 21 or inlet 21A respectively using bypass valve 26 or 26A respectively if the two aforementioned temperature limiting means do not sufficiently limit the temperature increase of the superheated motive fluid. In such a case, waste heat gases are diverted by bypass valve 26 or 26A respectively, to cause a temporary decrease in the heat influx to SH coils 24 or 24A respectively, during the occurrence of one of several events including: (a) the temperature of the waste heat gases exiting WHVG 20 or 20A as detected by temperature sensor 79 or 79A is excessive; (b) the temperature of superheated vapors supplied to turbine 40 or 40A via pipe 32 or 32A as detected by temperature sensor 72 or 72A is excessive; (c) the flow rate of motive fluid in pipe 38 or 38A as detected by flow meter 86 or 86A is relatively low; and (d) the pressure of the motive fluid contained within separator 44 is greater than a predetermined pressure, as detected by sensor 83, indicating that the pressure of the superheated motive fluid is liable to reach a pressure which may cause degradation or ignition of the motive fluid. Waste heat gases exiting WHVG 20 via bypass valve 26 or 26A are discharged to a stack.

Boiler supply valve 75 in fluid communication with pipe 64 regulates the flow of the separated liquid phase fluid to BLR coils 25, in order to maintain a substantially constant wall temperature which is less than a predetermined temperature at the heat transfer surface of the boiler. In the embodiment described with reference to FIG. 2, supply valve 75A in fluid communication with pipe 64A regulates the flow of motive fluid liquid from pipe 38A in order to maintain substantially constant temperature in BLR 25A. The temperature of the superheated motive fluid is liable to rise above a desired level if the wall temperature of BLR coils 25 or the temperature of the motive fluid in BLR 25A is excessive. Pump 57 ensures that a predetermined mass flow rate of motive fluid is delivered to BLR 25 and that the wall temperature of the boiler coils is less than a predetermined temperature. Accordingly, controller 76 of boiler supply valve 75 regulates the flow of the separated liquid phase flow into the boiler inlet in response to (a) the level of fluid within separator 44 as detected by level sensor 81; (b) the flow rate of separated liquid phase motive fluid discharged from pump 57, as detected by sensor 78; or (c) the flow rate of heated condensate flowing through pipe 38 and being delivered to PH coils 23, as detected by sensor 86.

The supply level of cycle pump 53 in turn is dependent on (a) the level of fluid within condenser 50, as detected by sensor 52; (b) the level of fluid within separator 44, as detected by low level sensor 81 or high level sensor 82; and also the temperature of the heat depleted waste heat gases in the outlet of WHVG 20. In the embodiment described with reference to FIG. 2, supply level of cycle pump 53A in turn is dependent on (a) the level of fluid within condenser 50A, as detected by sensor 52A; (b) the level of liquid in BLR 25A as detected by level sensor 81A; and also the temperature of the heat depleted waste heat gases in the outlet of WHVG 20A. If the temperature of the exhaust gas sensed by temperature sensor 79A is too low, on the other hand, preheater 23A is bypassed by operation of control valve 75A.

The main purpose of pump 57 is to ensure a reliable supply of motive fluid liquid in BLR coils 25 or BLR 25A, as described hereinabove via valve 75; however, pump 57 is also adapted to deliver separated liquid phase fluid to desuperheater valve 71, or to control valve 62, which is in fluid communication with pipe 61 and in electrical communication with low level sensor 81 of separator 44.

Even though pipe system 5 or 5A through which the motive fluid is a closed system, power system 10 or 10A is dynamic by virtue of control system 7 or 7A, whereby the flow rate of the motive fluid through different components of power system can instantly change. Separator 44 and condenser 50, BLR 25A and condenser 50A serve as means to accumulate a varying level of motive fluid, depending on the instantaneous operating conditions of power system 10 or 10A.

While some embodiments of the invention have been described by way of illustration, it will be apparent that the invention can be carried out with many modifications, variations and adaptations, and with the use of numerous equivalents or alternative solutions that are within the scope of persons skilled in the art, without departing from the spirit of the invention or exceeding the scope of the claims.

The invention claimed is:

1. A waste heat vapor generator for supplying organic motive fluid vapor to a turbogenerator, comprising:

an inlet connected to a source of waste heat gases and through which waste heat gases are introduced, an outlet from which heat depleted waste heat gases are discharged, a chamber interposed between said inlet and said outlet through which said waste gases flow, an organic motive fluid preheater in said chamber, an organic motive fluid provided in said preheater and flowing in heat exchange relation with said waste heat gases in said chamber, whereby organic motive fluid in said organic motive preheater receives heat from the waste heat gases, an organic motive fluid boiler, the organic motive fluid being provided in said boiler and flowing in heat exchange relation with said waste heat gases, wherein organic motive fluid in said organic motive boiler receives heat from the waste heat gases, and an organic motive fluid superheater, the organic motive fluid being provided in said superheater and flowing in heat exchange relation with said waste heat gases in said chamber, whereby organic motive fluid in said organic motive superheater receives heat from the waste heat gases, wherein said organic motive fluid boiler is connected to said preheater to receive preheated organic motive fluid from the preheater and is positioned upstream to said organic motive fluid superheater in the direction of the flow of the waste heat gases, and said organic motive fluid superheater is positioned upstream to said organic motive fluid preheater in the direction of the flow of the waste heat gases from the inlet to the outlet.

2. The waste heat vapor generator according to claim 1, wherein superheated motive fluid discharged from the superheater is delivered to a turbogenerator.

3. The waste heat vapor generator according to claim 1, wherein the motive fluid discharged from the preheater is delivered to the boiler.

4. The waste heat vapor generator according to claim 2, further comprising a bypass provided upstream of the superheater through which a portion of the waste heat gases flows when the temperature of the waste heat gases exiting the waste heat vapor generator is greater than a predetermined value.

5. An organic Rankine cycle power system, comprising an organic turbine module coupled to an electric generator, and a waste heat vapor generator for supplying superheated organic motive fluid vapor through a first pipe to the organic turbine module, the waste heat vapor generator comprising:

an inlet connected to a source of waste heat gases and through which waste heat gases are introduced, an outlet from which heat depleted waste heat gases are discharged, a chamber interposed between said inlet and said outlet through which said waste gases flow, an organic motive fluid preheater in said chamber, an organic motive fluid provided in said preheater and flowing in heat exchange relation with said waste heat gases in said chamber, whereby organic motive fluid in said organic motive preheater receives heat from the waste heat gases to preheat the organic motive fluid, an organic motive fluid boiler in said chamber, the organic motive fluid being provided in said boiler and flowing in heat exchange relation with said waste heat gases, whereby organic motive fluid in said organic motive boiler receives heat from the waste heat gases to evaporate the organic motive fluid, and an organic motive fluid superheater having a set of coils, the organic motive fluid being provided in said superheater and flowing in heat exchange relation with said waste heat gases in said chamber, whereby organic motive fluid in said organic motive superheater receives heat from the waste heat gases to superheat the organic motive fluid, wherein said organic motive fluid boiler is connected to said preheater to receive preheated organic motive fluid from the preheater and is positioned upstream to said organic motive fluid superheater in the direction of the flow of the waste heat gases, and said organic motive fluid superheater is positioned upstream to said organic motive fluid preheater in the direction of the flow of the waste heat gases from the inlet to the outlet.

6. The power system according to claim 5, further comprising means for limiting a temperature increase of the superheated organic motive fluid.

7. The power system according to claim 6, wherein the means for limiting a temperature increase of the superheated organic motive fluid is a desuperheating valve through which liquid organic motive fluid is supplied to a second pipe extending to the inlet end of the superheater.

8. The power system according to claim 7, wherein the desuperheating valve is operable to regulate the flow of motive fluid through a third pipe which extends to the second pipe in response to the temperature of the superheated motive fluid flowing through the first pipe.

9. The power system according to claim 7, further comprising a separator for receiving two-phase motive fluid from the organic motive fluid boiler and for separating said two-phase fluid into a vapor phase fluid and a liquid phase fluid, wherein said vapor phase fluid is delivered to the superheater via the second pipe.

10. The power system according to claim 9, further comprising a pump for delivering the liquid phase fluid to a boiler supply control valve at a predetermined mass flow rate and to the desuperheating valve.

11. The power system according to claim 5 wherein said organic turbine module comprises a single organic turbine.

12. The power system according to claim 5 wherein said organic turbine module comprises several organic turbines.

13. The power system according to 5 including a cycle pump for supplying liquid motive fluid from said condenser to said preheater in accordance with the level of the liquid in said organic motive fluid boiler.

14. The organic Rankine cycle power system according to claim 5, further comprising a recuperator connected to receive expanded vapors from the turbine module and to heat organic motive fluid in the set of coils.

15. The waste heat vapor generator according to claim 1, wherein a burner is not provided in the chamber to heat the organic motive fluid in any of said organic motive fluid preheater, said organic motive fluid boiler and said organic motive fluid superheater.

16. The organic Rankine cycle power system according to claim 5, wherein a burner is not provided in the chamber to heat the organic motive fluid in any of said organic motive fluid preheater, said organic motive fluid boiler and said organic motive fluid superheater.

* * * * *